US006364264B1

(12) United States Patent
Lai

(10) Patent No.: US 6,364,264 B1
(45) Date of Patent: Apr. 2, 2002

(54) RACK HOLDING STRUCTURE

(76) Inventor: Ming-Hsiao Lai, 8-26, Lane 2, Kung Chi Village, Ta Tsuen Hsiang Chang-Hua Hsien (TW)

( * ) Notice: Subject to any disclaimer, the term of this patent is extended or adjusted under 35 U.S.C. 154(b) by 0 days.

(21) Appl. No.: 09/634,799

(22) Filed: Aug. 7, 2000

(51) Int. Cl.[7] ..... A47H 1/14

(52) U.S. Cl. ..... 248/251; 248/222.14; 248/201; 211/105

(58) Field of Search ..... 248/251, 254, 248/221.11, 222.11, 222.13, 222.14, 231.91, 224.7

(56) References Cited

U.S. PATENT DOCUMENTS 5,026,012 A * 6/1991 Wang ..... 248/222.14
5,071,099 A * 12/1991 Kuo ..... 248/224.7
5,186,427 A * 2/1993 Semchuck ..... 248/251
5,875,903 A * 3/1999 Chen ..... 211/105.1
6,012,692 A * 1/2000 Meck ..... 248/222.14
6,113,045 A * 9/2000 Kuo ..... 248/222.14
6,199,808 B1 * 3/2001 Lin ..... 248/222.14
6,220,460 B1 * 4/2001 Pan ..... 211/87.01

* cited by examiner

*Primary Examiner*—Ramon O. Ramirez
*Assistant Examiner*—Holly N. Sy
(74) *Attorney, Agent, or Firm*—Harrison & Egbert

(57) ABSTRACT

A rack holding structure is formed of a base, a connection member, a tubular member, a padding member, a rack holding member, and a fastening screw. The connection member is located on the upper surface of the base and is fastened to the rack holding member in conjunction with the padding member and the tubular member. The base, the connection member, the tubular member, the padding member, and the rack holding member are held together by the fastening screw, which is engaged with a threaded hole of the rack holding member via the base, the connection member, the tubular member, and the padding member.

1 Claim, 5 Drawing Sheets

RACK HOLDING STRUCTURE

BACKGROUND OF THE INVENTION

1. Field of the Invention

The present invention relates generally to a rack, and more particularly to a structure for holding the rack.

2. Description of Related Art

As shown in FIG. 1, the conventional rack holding structure comprises a base and a holding arm extending from the base. Such conventional rack holding structure are rather monotonous in design and is therefore limited in marketability.

BRIEF SUMMARY OF THE INVENTION

The primary objective of the present invention is to provide a streamlined rack holding structure, which is formed of a base, a connection member, and a rack holding member. The connection member is located at one end of the base and is fastened at another end with the rack holding member. The base, the connection member, and the rack holding member are securely held together by a screw.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
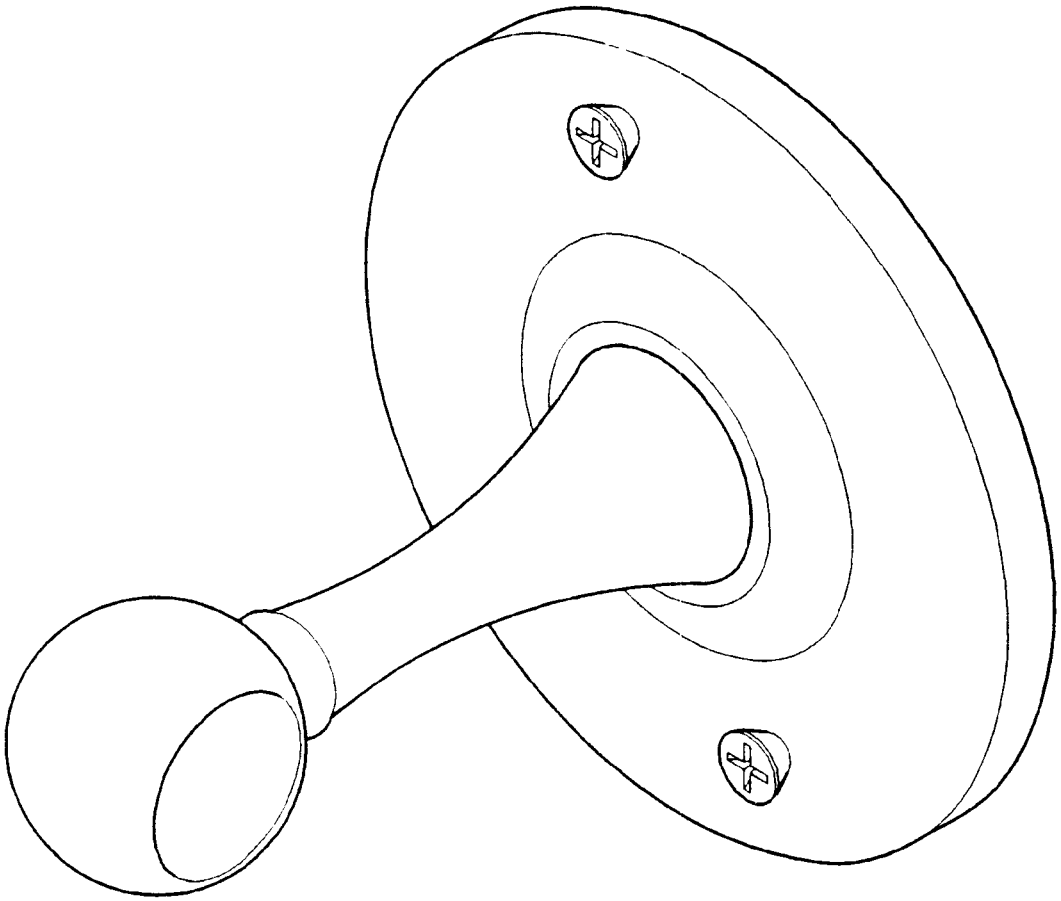
FIG. 1 PRIOR ART
FIG. 1 shows a perspective view of a rack holding structure of the prior art.
Figure 2:
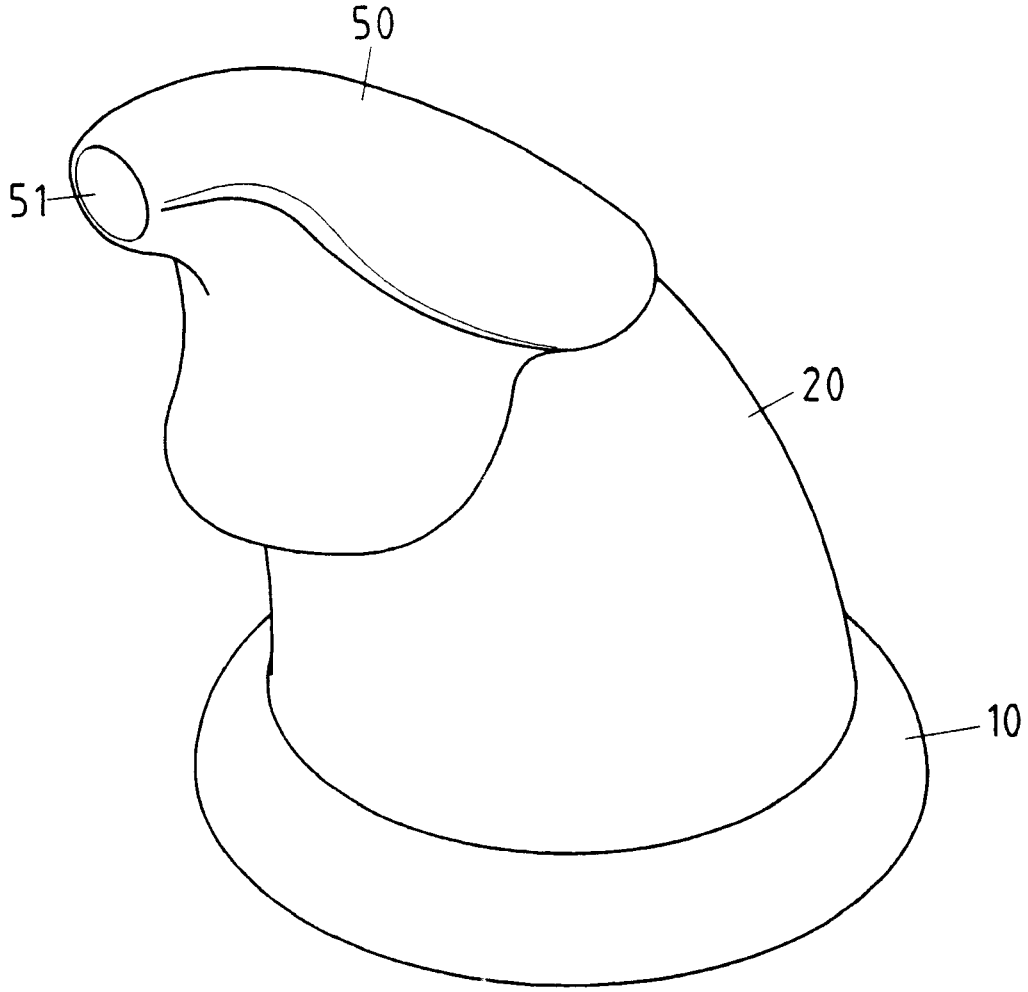
FIG. 2 shows a perspective view of the preferred embodiment of the present invention.
Figure 3:
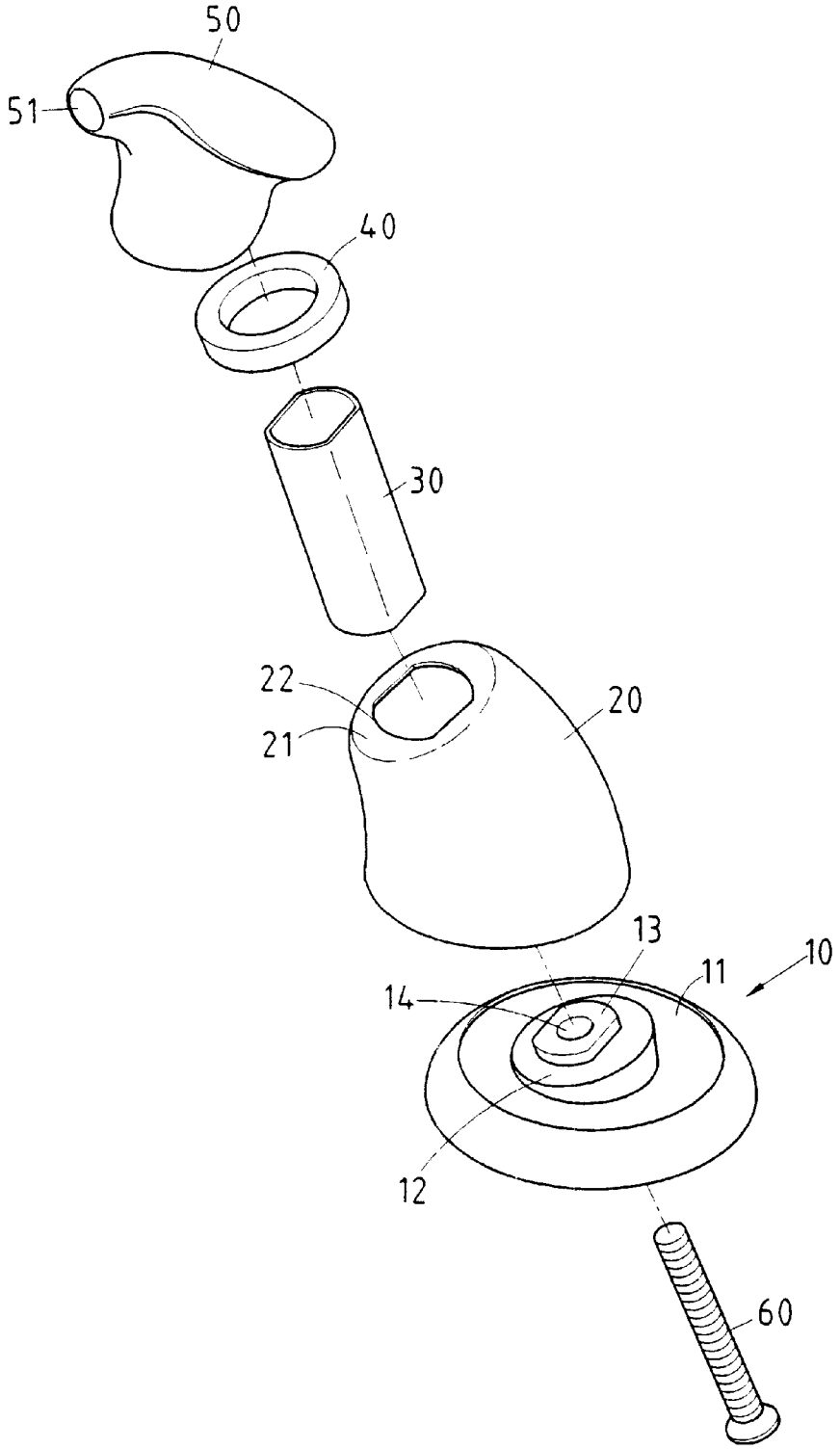
FIG. 3 shows an exploded view of the preferred embodiment of the present invention.

As shown in FIGS. 2–5, a rack holding structure embodied in the present invention comprises a base 10, a connection member 20, a tubular member 30, a padding member 40, a rack holding member 50, and a screw 60.

The base 10 is provided in the upper surface with a recess 11, an inclined plane 12 elevated from the recess 12, a protrusion 13 located on the inclined plane 12, and a through hole 14 extending through the underside of the base 10, the bottom wall of the recess 11, the inclined plane 12, and the protrusion 13.

The connection member 20 is provided with an inclined outer end 21 and a longitudinal through hole 22 which is dimensioned to receive the tubular member 30. The connection member 20 is mounted on the upper surface of the base 10.

The padding member 40 is rested on the inclined outer end 21 of the connection member 20 such that the padding member 40 is fitted over the outer end of the tubular member 30.

Figure 5:
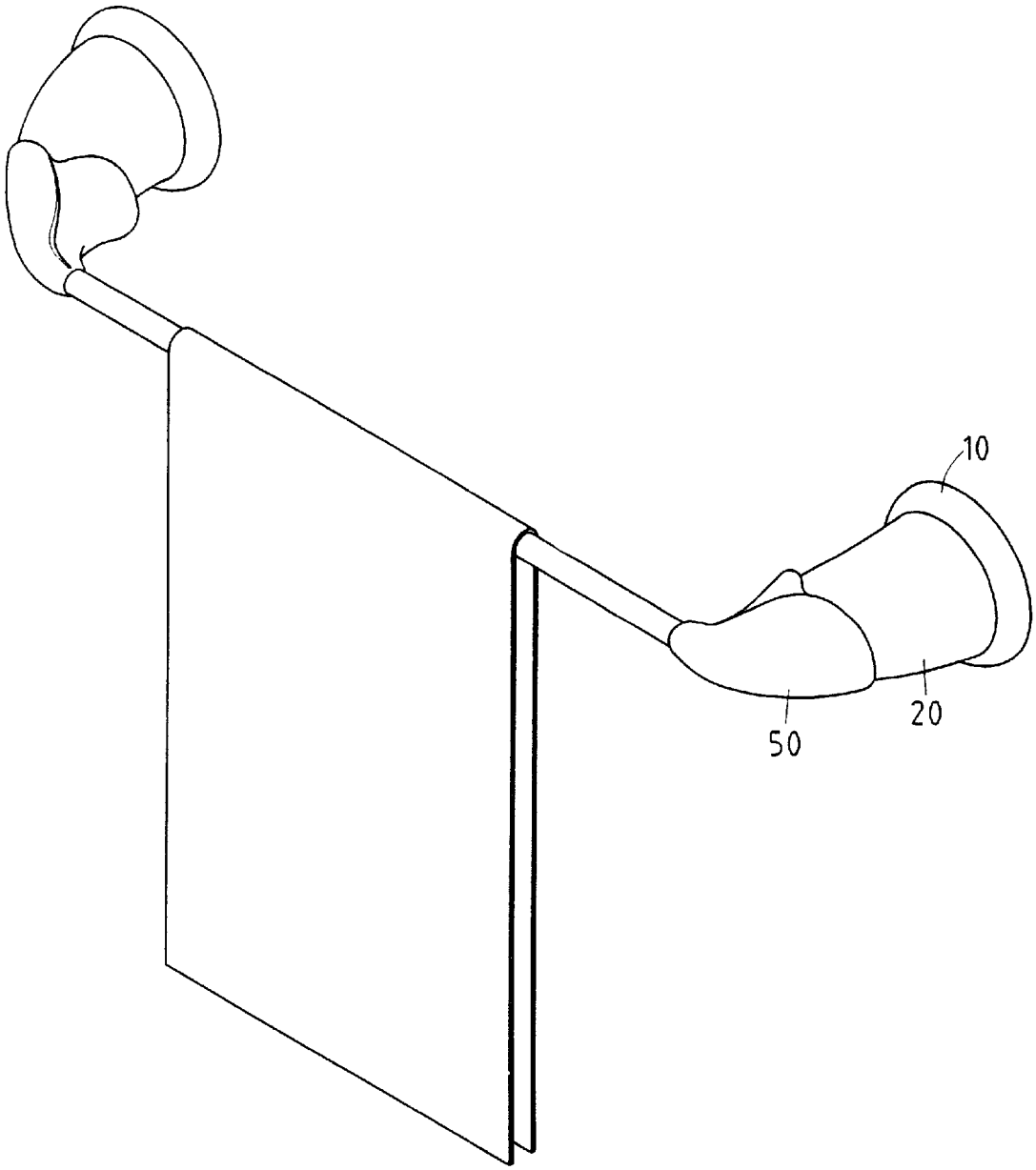
FIG. 5 shows a schematic view of the preferred embodiment of the present invention in use.

The rack holding member 50 is provided in the inner end with a receiving slot 52, which is dimensioned to receive the padding member 40 and is provided in the bottom wall with a threaded hole 53. The rack holding member 50 is provided at the outer end with a hanger receiving hole 51 for receiving one end of the hanger, as illustrated in FIG. 5.

Figure 4:
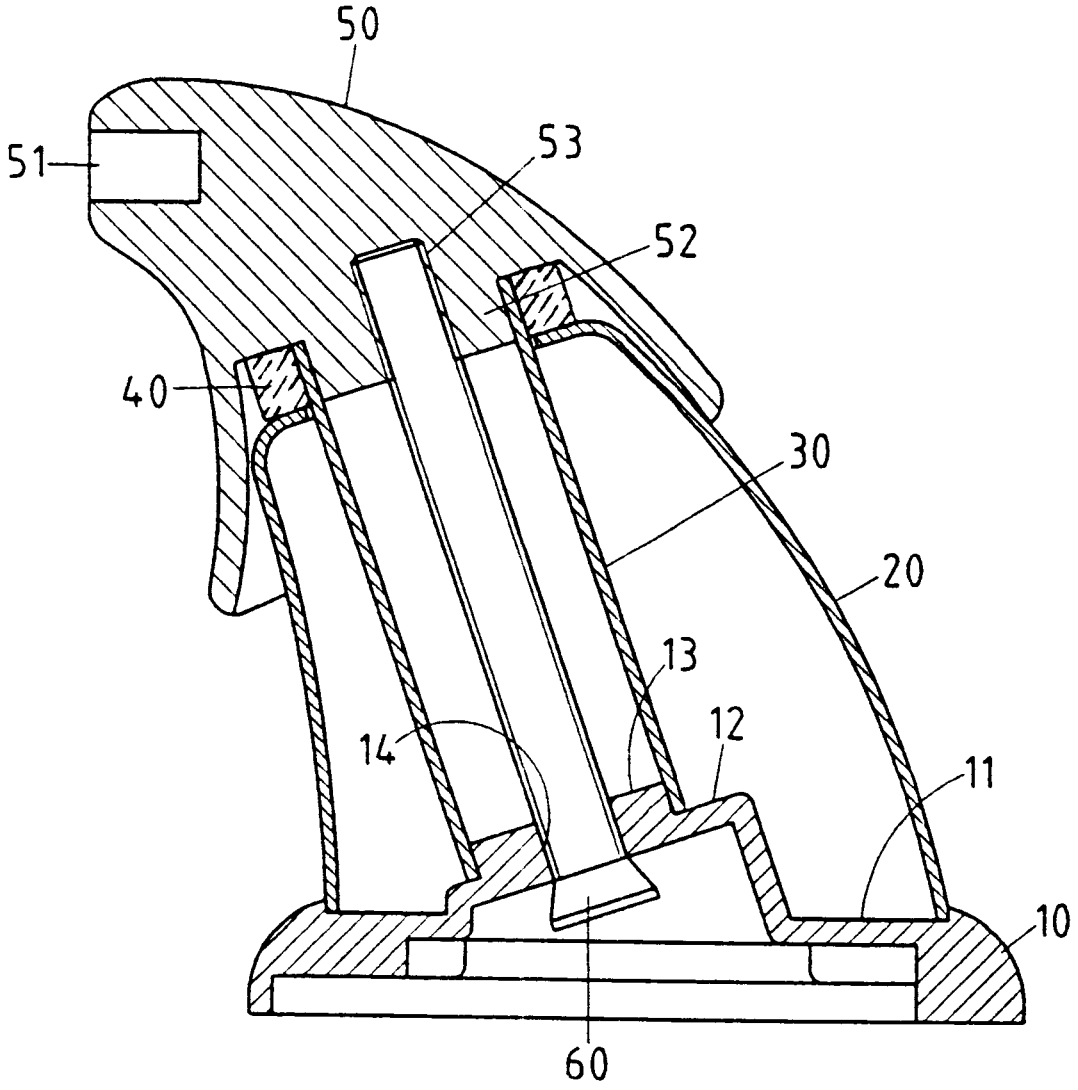
FIG. 4 shows a longitudinal sectional view of the preferred embodiment of the present invention.

The base 10, the connection member 20, the tubular member 30, the O-ring shaped padding member 40, and the rack holding member 50 are held together by the screw 60, which is engaged with the threaded hole 53 of the rack holding member 50 via the through hole 14 of the base 10, the longitudinal through hole 22 of the connection member 20, and the hollow center of the padding member 40, as shown in FIG. 4.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

I claim:

1. A rack holding structure comprising:

a base having a recess in an upper surface thereof, said base having an inclined plane elevated above said recess, said inclined plane having a protrusion formed on said inclined plane, said base having a through hole extending through an underside of said base and a bottom wall of said recess and said inclined plane and said protrusion;

a connection member having an inclined outer end and a longitudinal through hole, said connection member being mounted on said upper surface of said base;

a hollow tubular member having one end fitted onto and around said protrusion, said hollow tubular member having an upper end extending through a longitudinal through hole of said connection member;

a O-ring shaped padding member resting on said inclined outer end of said connection member such that said padding member is fitted over and around said upper end of said tubular member;

a rack holding member having a receiving slot receiving said padding member therein, said rack holding member having a threaded hole formed in a bottom wall thereof, said rack holding member having a hanger receiving hole formed in an outer end thereof; and a fastening screw securing said base and said connection member and said tubular member and said padding member and said rack holding member together, said fastening screw engaged with said threaded hole of said rack holding member, said fastening screw extending through said through hole of said base and said longitudinal through hole of said connection member and said hollow tubular member.

* * * * *